US005087804A

United States Patent [19]

McGaffigan

[11] Patent Number: 5,087,804

[45] Date of Patent: Feb. 11, 1992

[54] SELF-REGULATING HEATER WITH INTEGRAL INDUCTION COIL AND METHOD OF MANUFACTURE THEREOF

[75] Inventor: Thomas H. McGaffigan, Half Moon Bay, Calif.

[73] Assignees: Metcal, Inc., Menlo Park, Calif.; Amp, Inc., Middletown, Pa.

[21] Appl. No.: 635,790

[22] Filed: Dec. 28, 1990

[51] Int. Cl.[5] ..... H05B 6/40

[52] U.S. Cl. ..... 219/10.43; 219/9.5; 219/10.79; 29/602.1

[58] Field of Search ..... 219/10.43, 10.41, 9.5, 219/10.53, 10.75, 10.79; 29/602.1

[56] References Cited

U.S. PATENT DOCUMENTS

| | | | |
|---|---|---|---|
| 1,975,436 | 10/1934 | Sorrel et al. | 219/13 |
| 1,975,437 | 10/1934 | Sorrel et al. | 219/13 |
| 1,975,438 | 10/1934 | Sorrel | 219/13 |
| 3,378,917 | 4/1968 | Lapham | 219/10.79 |
| 3,391,846 | 7/1968 | White | 229/17 |
| 3,461,014 | 8/1969 | James | 156/272 |
| 3,510,619 | 5/1970 | Leatherman | 219/10.53 |
| 3,528,867 | 9/1970 | Leatherman | 156/272 |
| 3,548,140 | 12/1970 | O'Neill | 219/10.53 |
| 3,551,223 | 12/1970 | Deal et al. | 149/15 |
| 3,709,775 | 1/1973 | James | 161/162 |
| 3,902,940 | 9/1975 | Heller, Jr. et al. | 156/79 |
| 3,945,867 | 3/1976 | Heller, Jr. et al. | 156/143 |
| 4,035,547 | 7/1977 | Heller, Jr. et al. | 219/10.53 |
| 4,107,506 | 8/1978 | Pelegri | 219/85 A |
| 4,223,209 | 9/1980 | Diaz | 219/549 |
| 4,256,945 | 3/1981 | Carter et al. | 219/10.75 |
| 4,362,917 | 12/1982 | Freedman et al. | 219/10.55 E |
| 4,369,284 | 1/1983 | Chen | 524/476 |
| 4,571,472 | 2/1986 | Pollack et al. | 219/10.43 |
| 4,654,511 | 3/1987 | Horsma et al. | 219/548 |
| 4,695,713 | 9/1987 | Krumme | 219/553 |
| 4,777,063 | 10/1988 | Dubrow et al. | 427/44 |
| 4,789,767 | 12/1988 | Doljack | 219/9.5 |
| 4,795,870 | 1/1989 | Krumme et al. | 219/9.5 |
| 4,823,106 | 4/1989 | Lovell | 338/212 |
| 4,865,905 | 12/1989 | Uken | 428/220 |
| 4,914,267 | 4/1990 | Derbyshire | 219/85.1 |

OTHER PUBLICATIONS

Lee, E. W., *Magnetism, An Introductory Survey,* (1970) pp. 201-204.

Murakami, K., *IEEE Transactions on Magnetics,* (Jun. 1965) pp. 96-100.

Smit et al., *Ferrites,* (1959) pp. 155-160.

Smith et al., *Adv. Electronics,* 6:69 (1954).

Chen, *Magnetism and Metallurgy of Soft Materials,* (1986).

*Primary Examiner*—Philip H. Leung

*Attorney, Agent, or Firm*—Burns, Doane, Swecker & Mathis

[57] ABSTRACT

A self-regulating heater including a body of electrically non-conductive material, an induction coil embedded within the body, lossy heating particles dispersed within the body and connection terminals for supplying power to the induction coil. The lossy heating particles produce heat when subjected to an alternating magnetic field produced by the induction coil. The lossy heating particles have a Curie temperature approximately equal to a substantially constant auto-regulation temperature at which the body is heated. The connection terminals supply power to the induction coil so that the induction coil can produce an alternating magnetic field of sufficient intensity to cause the lossy heating particles to heat the body to the auto-regulation temperature. A method of manufacturing a self-regulating heater including providing a body of an electrically non-conductive material, providing an induction coil embedded within the body, providing lossy heating particles dispersed within the body, and providing connection terminals for supplying power to the induction coil. The induction coil can be embedded within the body by molding the material containing lossy heating particles around the induction coil.

34 Claims, 2 Drawing Sheets

SELF-REGULATING HEATER WITH INTEGRAL INDUCTION COIL AND METHOD OF MANUFACTURE THEREOF

FIELD OF THE INVENTION

This invention relates to an auto-regulating heater as well as to a method of manufacturing such a heater.

BACKGROUND OF THE INVENTION

In general, heaters including electric resistance heating elements are well known in the art. Such heaters rely upon external electrical control mechanisms to adjust the temperature of such resistance heating elements. To attain a desired temperature, such heating elements are cycled on and off to maintain the heating elements within a prescribed range of temperatures. Such heating elements fail to provide uniform heating throughout the resistance elements. That is, such heating elements generally exhibit hot spots and thus do not provide uniform heating at a desired temperature throughout the entire volume of the heating element.

In the metallurgical field, induction heaters are commonly used to melt metal. In particular, a crucible containing a metal charge to be melted is placed within an induction coil, and an alternating current is passed through the induction coil to cause the metal charge to be melted.

The use of ferrite particles to produce heating in alternating magnetic fields is known in the art. As disclosed in U.S. Pat. No. 3,391,845 to White, and U.S. Pat. No. 3,902,940 to Heller et al., ferrite particles and other particles have been used to produce heat where it is desired to cause chemical reactions, melt materials or evaporate solvents.

U.S. Pat. No. 4,914,267 to Derbyshire (hereinafter "Derbyshire") relates to connectors containing fusible materials to assist in forming a connection, the connectors forming part of a circuit during the heating of the fusible material. In particular, the temperature of the connectors is auto-regulated at about the Curie temperature of the magnetic material included in the circuit during the heating operations. The connector may be a ferromagnetic member or may be a part of a circuit including a separate ferromagnetic member.

Derbyshire explains that auto-regulation occurs as a result of the change in value of mu (a measure of the ferromagnetic properties of the ferromagnetic member) to approximately 1 when the Curie temperature is approached. In particular, the current spreads into the body of the connector thus lowering the concentration of current in a thin layer of magnetic material, and the skin depth changes by at least the change in the square root of mu. Resistance to current flow reduces, and if the current is held at a constant value, the heating effect is reduced below the Curie temperature, and the cycle repeats. Thus, the system auto-regulates about the Curie temperature.

Derbyshire discloses embodiments wherein the connector is made of ferromagnetic material, a high frequency constant current a.c. is passed through the ferromagnetic material causing the connector to heat until its Curie temperature is reached. When this happens, the effective resistance of the connector reduces and the power dissipation falls such that by proper selection of current, frequency and resistivity and thickness of materials, the temperature is maintained at about the Curie temperature of the magnetic material of the connector.

In another embodiment, a laminar ferromagnetic-non-magnetic heater construction comprises a copper wire, tube, rod or other metallic element in a ferromagnetic sleeve. In this case, current at proper frequency applied to opposite ends of the sleeves flows through the sleeve due to the skin effect until the Curie temperature is reached, at which time the current flows primarily through the copper wire. In a still further embodiment, the connector includes a copper sleeve with axially-spaced rings of high mu materials of different Curie temperatures so as to produce different temperatures displaced in time and space.

An object of this invention is to provide a heater device having improved properties and utility.

SUMMARY OF THE INVENTION

The invention provides a self-regulating heater which includes a body comprising electrically non-conductive material and an induction coil embedded within the body. Lossy heating particles are dispersed within the body. The lossy heating particles produce heat when subjected to an alternating magnetic field by the induction coil. The lossy heating particles have a Curie temperature approximately equal to an auto-regulation temperature to which the body is heated. Connection means is provided for supplying power to the induction coil so that the induction coil can produce an alternating magnetic field of sufficient intensity to cause the lossy heating particles to heat the body to the auto-regulation temperature.

The lossy heating particles can comprise ferrimagnetic or ferromagnetic particles. Preferably, the lossy heating particles comprise ferrites. The lossy heating particles are preferably evenly distributed throughout all of the body. The electrically non-conductive material of the body can comprise any suitable material such as a plastic, ceramic, polymer, silicone, elastomer, rubber or gel-type material. Preferably, the body is molded around the induction coil. The induction coil can comprise an elongated member which is cylindrical or flat in cross-section. The induction coil can be any desired shape which can be located between opposed surfaces of the body and produce the desired magnetic field for heating the lossy heating particles in the body.

The invention also provides a method of manufacturing a self-regulating heater. The method includes providing a body of electrically non-conductive material, providing an induction coil embedded within the body, providing lossy heating particles dispersed within the body, and providing connection means for supplying power to the induction coil. The lossy heating particles produce heat when subjected to an alternating magnetic field by the induction coil, and the lossy heating particles have a Curie temperature approximately equal to the auto-regulation temperature to which the body is to be heated. The connection means provides power to the induction coil so that the induction coil can produce an alternating magnetic field of sufficient intensity to cause the lossy heating particles to heat the body to the auto-regulated temperature.

In a preferred embodiment, the induction coil is embedded within the body by molding the electrically non-conductive material around the induction coil. Alternatively, the body can include a cavity therein, and the induction coil can be supported in the cavity. The lossy heating particles can be distributed throughout all or part of the body. The lossy heating particles can comprise ferrimagnetic or ferromagnetic particles but preferably comprise ferrites. The electrically non-conductive material of the body can comprise any suitable material such as a plastic, ceramic, polymer, silicone, gel-type, elastomer or rubber material.

BRIEF DESCRIPTION OF THE DRAWING

The invention will now be described with reference to the accompanying drawing, in which.

DETAILED DESCRIPTION OF THE PREFERRED EMBODIMENTS

Figure 1:
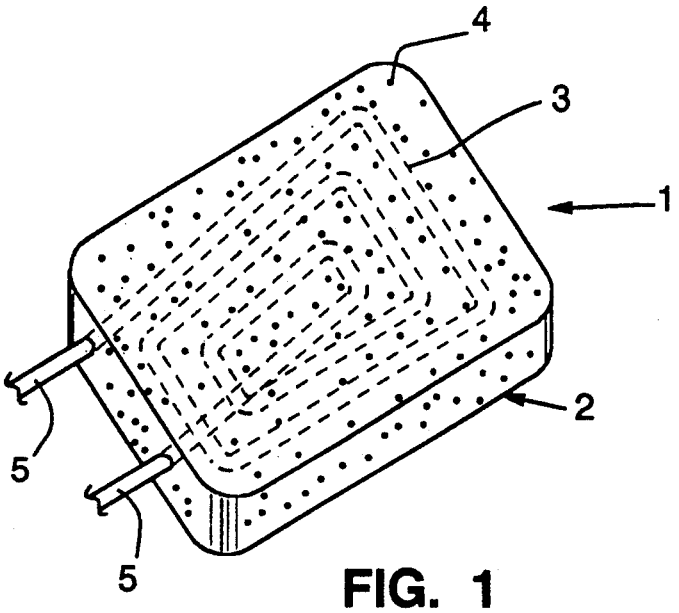
FIG. 1 shows an auto-regulating heater in accordance with the invention.

This invention utilizes the phenomenon that lossy magnetic particles, such as lossy ferrites, produce heat when subjected to an alternating magnetic field of an appropriate frequency. These lossy heating particles are self-regulating with respect to the maximum temperature they will heat to in the appropriate alternating magnetic field. The reason for this is that the particles exhibit a decline in magnetic permeability and hysteresis losses as the Curie temperature is approached and reached. When the Curie temperature is achieved, the magnetic permeability of the ferrite particles drops significantly, the hysteresis loss diminish, and the particles cease producing heat from the alternating magnetic field. This property of being self-regulating at a maximum temperature equal to the Curie temperature of the particles makes the particles particularly useful in many applications.

I have developed the present invention in order to provide a more convenient and economical form of heater device in which lossy magnetic heating particles are used to provide auto-regulation at the desired temperature. The heater device of this invention has utility in many applications to heat articles by means of an alternating magnetic field produced within the heater device itself.

In the present invention I have provided a self-regulating heater incorporating an internal induction coil whereby the alternating magnetic field for heating the lossy heating particles is produced internally within the heater itself.

The term "lossy heating particles" as used herein means any particles having particular properties which result in the particles being capable of generating sufficient heat, for the purposes of this invention, when subjected to an alternating magnetic field having a specified frequency. Thus, any particle having these properties and being useful in the present invention is within the scope of this definition. It should be noted that there has been inconsistent and/or confusing terminology used in association with the materials which respond to magnetic fields. While not being bound by particular terminology, the lossy heating particles useful in this invention generally fall into two categories of materials known as ferrimagnetic materials and ferromagnetic materials.

In general, the ferrimagnetic particles, such as ferrites, are preferred because they are usually non-conductive particles and because they produce heat by hysteresis losses when subjected to an alternating magnetic field. Therefore, the ferrimagnetic particles will produce heating by hysteresis losses in the appropriate alternating magnetic field, essentially regardless of whether the particle size is large or small. Ferrimagnetic particles are also preferred in many end use applications because the heater can remain electrically non-conductive.

Also useful in this invention, and preferred in some applications, are the ferromagnetic particles which are usually electrically conductive. Ferromagnetic particles will produce heating dominated by hysteresis losses if the particle size is small enough. However, since ferromagnetic particles are conductive, larger particles will produce significant heating by eddy current losses. When ferromagnetic particles are used in this invention, it is usually necessary to assure that the particles are sufficiently electrically insulated from each other to avoid forming conductive pathways through the heater, which could cause an internal short circuit.

It is generally preferred in the practice of this invention to provide heating by hysteresis losses because the particle size can be much smaller for effective hysteresis loss heating than with the effective eddy current heating. When the particles are dispersed in a non-conducting matrix, i.e., for hysteresis loss heating, the smaller particle size enables more uniform heating of the material and does not degrade the mechanical properties of the material. The reason for this is that the smaller particles can be dispersed to a greater extent than larger particles, and the article can remain non-conductive. The more dispersed, smaller particles thereby usually provide more efficient heating. However, the particle size is to be at least one magnetic domain in size, i.e., the particles are preferably as small as practical but are multi-domain particles.

The heating produced by the lossy heating particles useful in the present invention can be either provided by or can be enhanced by coating the particles with an electrically-resistive coating. As will be recognized by one skilled in the art, particles that are not lossy because they do not exhibit eddy current losses can be converted to lossy heating particles for use in this invention by placing such a coating on the particles. The coating produces eddy current losses associated with the surface effect of the coated particles. At the same time, particles which are lossy due to hysteresis losses can be enhanced in their effectiveness for some applications by such coatings. Accordingly, lossy particles can be provided which produce heating both by hysteresis losses and by eddy current losses.

It is known that ferrites can possess any range of Curie temperatures by compounding them with zinc, magnesium, cobalt, nickel, lithium, iron, or copper, as disclosed in two publications: "The Characteristics of Ferrite Cores with Low Curie Temperature and Their Application" by Murkami, *IEEE Transactions on Magnetics*, June 1965, page 96, etc., and *Ferrites* by Smit and Wijn, John Wiley & Son, 1959, page 156, etc. Therefore, selection of lossy heating particles to provide desired Curie temperatures will be apparent to one skilled in the art.

The magnetic particles useful as and included within the scope of the term "lossy heating particles" for the present invention have the following properties: (1) a desired Curie temperature for auto-regulation of the temperature when subjected to an appropriate alternating magnetic field, and (2) are sufficiently lossy, either by hysteresis losses, by eddy current losses, or both, in order to produce the desired heat when subjected to the alternating magnetic field.

The lossy heating particles useful in this invention can be any desired particles which have the desired Curie temperature and which are sufficiently lossy to produce the desired amount of heating in the alternating magnetic field intended for use in connection with the systems of this invention. As discussed in my International Publication No. WO 90/03090, it will be understood by those skilled in the art that these lossy heat-producing particles are in general ferrimagnetic or ferromagnetic particles which have a high initial permeability and a highly lossy component in a particular frequency range of the alternating magnetic field being used.

As is known in the art, the lossy component of ferrite particles is generally that part of the initial relative permeability which contributes to heating. This part is referred to as the mu" by Chen, *Magnetism and Metallurgy of Soft Magnetic Materials,* page 405 (1986) and Smit et al., *Advanced Electronics,* 6:69 (1954). The higher the mu" component for a particular particle, the more effective the particle will be when used as the lossy heating particles in this invention in producing heat at a particular frequency of the magnetic field.

The heat production from such particles in a alternating magnetic field is directly related to the lossy component, particle size, field strength, the frequency of the alternating current powering the magnetic field, the distribution density of the particles present, as well as other factors known in the art. Particles can be readily selected for their initial magnetic permeability and their highly lossy, heat-producing properties in a particular magnetic field having a particular frequency and field strength. The particle size should be greater than one magnetic domain but otherwise can be any desired particle size. The smaller particle sizes are generally preferred for more efficient heating in many applications. The distribution density of the particles used in the system of this invention will be determined by various factors. It is generally desired, however, to use the minimum density of particles which will produce the desired heating in the magnetic field selected for use with those particles. However, a higher density of particles will provide a higher watt density device.

A preferred and useful particle system for use in the present invention comprises lossy heating particles used in combination with non-lossy particles. The lossy heating particles produce the heat for heating the articles according to the present invention. The non-lossy particles provide the continued magnetic circuit coupling when the lossy heating particles reach their Curie temperature and their magnetic permeability is reduced. The combination of lossy heating particles and non-lossy particles can be particularly useful in the heater and systems of the present invention in some instances. For example, the combination of the lossy and non-lossy particles allows the full intensity of the magnetic field to be maintained as the article is heated to its self-regulation temperature. Selection of the particular magnetic particles or particle system for use in this invention will be apparent to one skilled in the art following the disclosure.

Auto-regulating heater 1 in accordance with one embodiment of the invention is shown in FIG. 1. Heater 1 includes a body of electrically non-conductive material 2, an induction coil 3 embedded within body 2, lossy heating particles 4 dispersed within body 2 and connection means 5 for supplying power to induction coil 3. Lossy heating particles 4 produce heat when subjected to an alternating magnetic field by induction coil 3. The lossy heating particles have a Curie transition temperature at least equal to an auto-regulated temperature at which body 2 is to be heated. Connection means 5 enables power to be supplied to induction coil 3 so that induction coil 3 can produce an alternating magnetic field of sufficient intensity to cause lossy heating particles 4 to heat body 2 to heat to the auto-regulated temperature.

Body 2 can comprise any suitable electrically non-conductive material such as a plastic, ceramic, polymer, silicone, elastomer, rubber or gel-type material. For instance, the material can be a material which is rigid or flexible at the auto-regulated temperature. If body 2 is flexible and the induction coil contained therein is flexible, heater 1 can conform to an article to be heated. For instance, the flexible material would conform to an uneven surface when the body is heated to the substantially constant auto-regulated temperature thereby applying heat uniformly to the uneven surface.

If body 2 is of an elastomeric-type material and the article to be heated changes shape during the heating, heater 1 can conform to the shape of the article as it changes shape. Rigid materials include ceramic, plastic, polymer or other materials. Flexible materials include natural and synthetic rubber, elastomeric, gel-type and other materials. To utilize heat from the lossy heating particles, however, the material of body 2 should be capable of conducting heat to the article to be heated.

According to one aspect of the invention, body 2 can be a gel-type material which is soft and has a high elongation. Such materials are disclosed in U.S. Pat. Nos. 4,369,284 and 4,777,063 and 4,865,905. Such material enables the construction of heaters according to this invention which are very flexible and conformable to irregular substrates to be heated.

Preferred materials for many applications of the heaters of this invention are elastomers and rubbers such as RTV silicones. While the material used can be thermoplastic in nature for melting and encapsulating the induction coil, it is usually preferred to use a curable material to cast and encapsulate the induction coil to form the heaters of this invention.

The lossy heating particles can be incorporated in and dispersed in the material when body 2 is manufactured by curing or melting the material.

Figure 2:
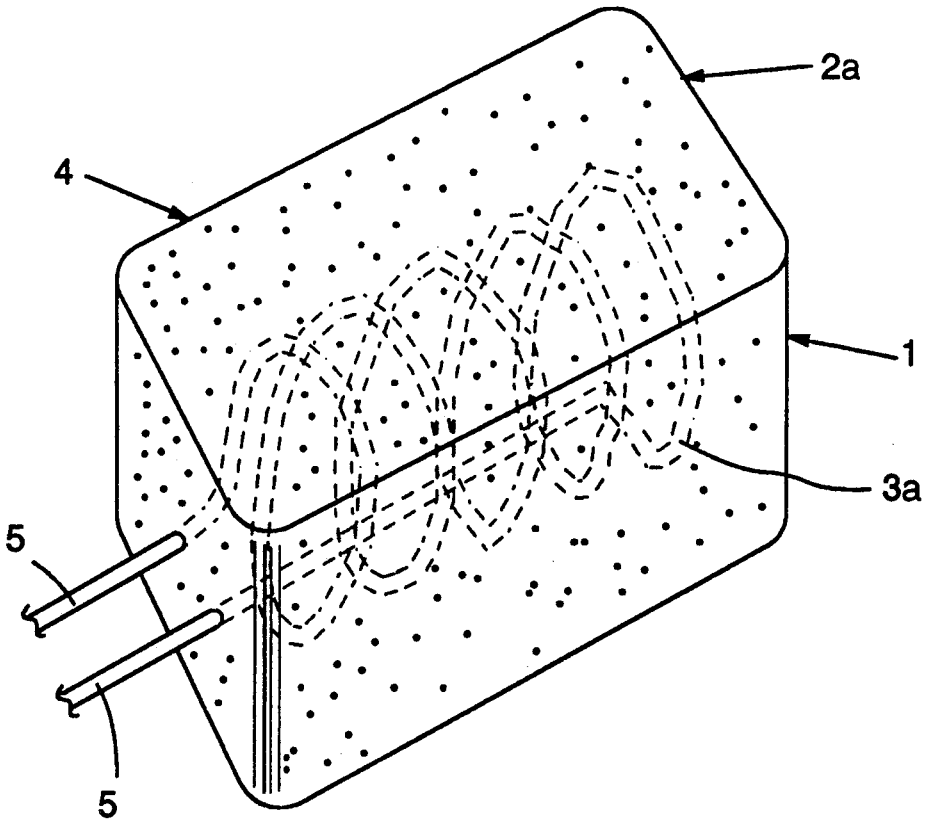
FIG. 2 shows an auto-regulating heater in accordance with another embodiment of the invention.
Figure 3:
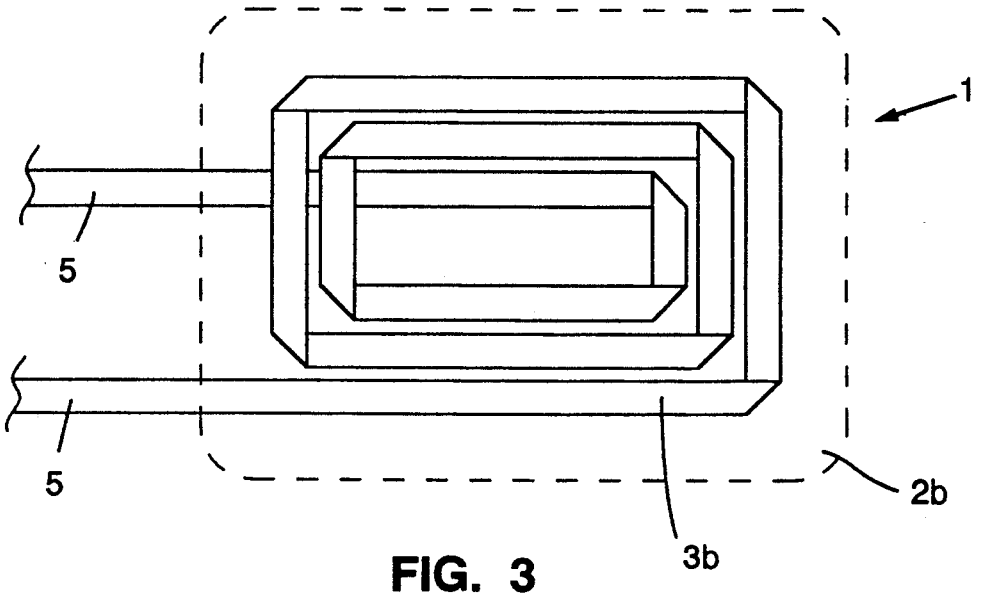
FIG. 3 shows a top view of one type of an induction coil which can be used in a heater according to the invention.
Figure 4:
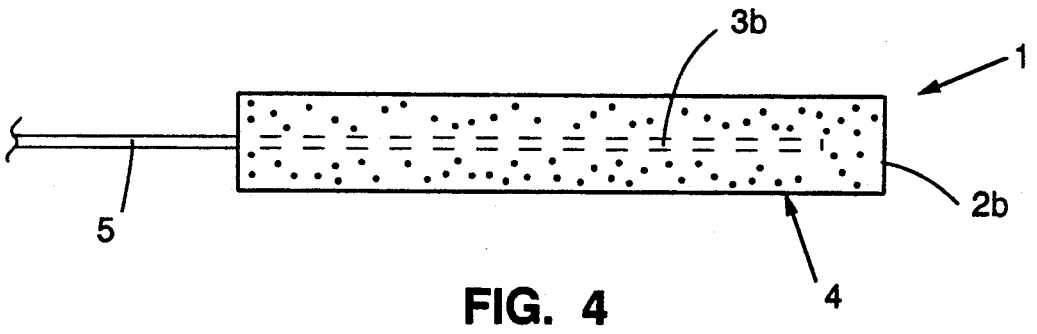
FIG. 4 shows a side view of the heater shown in FIG. 3.
Figure 5:
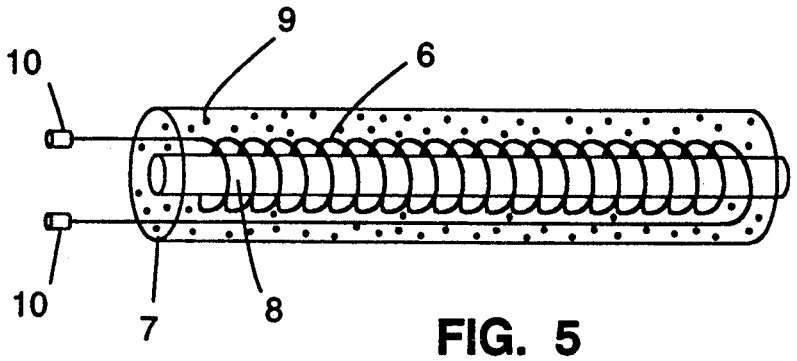
FIG. 5 shows an elongate heater according to this invention.

Induction coil 3 can be provided in a number of forms. As shown in FIGS. 1, 3 and 4, induction coil 3 can be a substantially coplanar coil. Alternatively, as shown in FIGS. 2 and 5, induction coil 3 and 6, respectively, can be in the form of a helical coil. The helical coils can be close together or spaced apart. The spaced apart helical coils will provide more flexibility to body 2*a* than in cases wherein the helical coils are closely spaced or are in contact with each other. If desired, helical induction coil 3*a* could be stretched in a longitudinal direction when body 2*a* of material is molded therearound, thereby providing even greater flexibility to molded body 2*a*.

Another form of the induction coil is shown in FIGS. 3 and 4. In this case, induction coil 3*b* comprises a polyimide coated copper ribbon which is folded over to form sections of rectangular coils which are substantially coplanar with each other, as shown in FIG. 4. The arrangements shown in FIGS. 1 and 4 provide relatively thin bodies 2 and 2*b*, respectively. The arrangement shown in FIG. 2 provides a relatively thick body 2*a* due to the shape of induction coil 3*a*. Body 2*a* can be molded around the induction coil, or body 2*a* could include a cavity therein in which induction coil 3*a* is supported. For instance, the body could be provided in two pieces which are fastened together around induction coil 3*a*.

Connection means 5 of heater 1 can be connected to an alternating current power supply. For instance, an alternating current power supply can be connected to induction coil 3 through means which is part of a circuit formed with series and parallel capacitors as known by one skilled in the art. The circuit can be tuned to a resonance impedance of 50 ohms with the load applied. A suitable power source including a constant current power supply can be provided by a Metcal Model BM 300 power supply (available from Metcal, Inc., Menlo Park, Calif.), which is a 600-watt 13.56 MHz constant current power supply. The power supply can be regulated in the constant current mode by a current sensor and feedback loop. The internal induction coil 3 used in accordance with the invention can comprise a 0.006 in.×0.160 in. copper ribbon. Other configurations of constant current power supply and induction coil arrangements will be apparent to one skilled in the art.

Many possibilities exist for the shape of body 2. For instance, the induction coil could be substantially planar, and the body could be plate-shaped and slightly larger than the induction coil, as shown in FIGS. 1 and 3. Alternatively, such a planar induction coil could be provided in one-half of a thin rectangular body at one end thereof. If a helical induction coil is used, as in FIG. 2, the body could be cubical in shape.

In view of the above general description and the description of particular embodiments, it will be apparent to one skilled in the art following these teachings that numerous variations and embodiments of this invention can be adapted for various desired uses.

The following example is set forth to illustrate a particular preferred embodiment of the heater of the invention. It is to be understood that the above description and the following example are set forth to enable one skilled in the art to practice this invention, and the scope of this invention is defined by the claims appended hereto.

EXAMPLE I

In this example, a heater according to the invention was made using GE Silicone RTV627 A and B with a three turn flat coil and TT1-1500 ferrite from Trans Tech. The Curie transition temperature (Tc) of the ferrite was 180° C. The induction coil had the arrangement shown in FIG. 3 and was molded in the RTV627 A and B silicone. The performance of the heater was as follows: max net power, 250 watts; reflected power after regulation, 100 watts.

This heater locally self-regulated both two-dimensionally and three-dimensionally. This heater is compliant and may be a better choice for irregular surfaces such as in a flex etch circuit hot bar application. A valuable characteristic of this heater is that it is inherently self-regulating three-dimensionally.

EXAMPLE II

In this example, a heater according to this invention was made using GE Silicone RTV627. The coil was formed by winding 32 turns of 24 gage HML wire around a 6 inch long, 0.25 inch diameter teflon mandrel, about 10 turns per inch, and leaving wire leads extending from one end. This assembly was placed in the lower half of "Delrin" plastic mold 4.5 inches in length having a 3 inch long, 0.5 inch diameter cavity and having 0.25 inch holes in each end at the parting line for receiving the ends of the mandrel extending out the ends of the mold. A mixture of 15 grams of the RTV silicone and 30 grams of ferrite powder was poured under and on top of the coil/mandrel assembly. The top half of the mold was pressed into position and the RTV silicone allowed to cure. The ferrite powder was a 50/50 mixture of TT1-2800, a lossy ferrite particle having a Curie temperature of 225° C., and TT2-111, a non-lossy ferrite particle having a Curie temperature of 375° C. After the RTV silicone was cured, the mandrel was removed from the center leaving a cylindrical cavity in the heater. This cavity was then filled with the same RTV silicone/ferrite particle mixture and allowed to cure. Then the heater device was removed from the mold. The resulting heater device of this invention was impedance matched to a Metcal power supply and demonstrated effective heating, self-regulating at 225° C. A similar heater was made using 30 grams of powder which was 75% by volume of the above 50/50 mixture of ferrite particles and 25% by volume of fine copper powder. This heater showed enhanced heat output due to better thermal conductivity of the heater body.

An advantage of the heater according to this invention is that the entire body can be heated to a substantially uniform and constant temperature. For instance, when the lossy heating particles are dispersed throughout all of body 2, the lossy heating particles are heated as follows: (1) when the body is cold the magnetic flux is concentrated close to the induction coil, thus causing lossy heating particles closest to the induction coil to be heated; (2) once this material closest to the induction coil reaches its Curie temperature, the permeability drops and the magnetic flux expands outward, thereby preventing overheating of the central core, the effect serving to force the entire block of loaded material to generate heat. Accordingly, heat is generated not only in the material close to the induction coil, and thus in the central core, but also in the material located furthest from the induction coil. Thus, heat is generated and regulated in a three-dimensional manner.

The heaters of this invention have particularly useful properties and characteristics. The heaters are incrementally and locally self-regulating along the length or throughout the area of the heater, so that it provides uniform temperature at the selected Curie temperature throughout the heater. The heaters also have an inherent variable watt density along the length or throughout the area of the heater, i.e., the heater will draw power incrementally and locally to each cold location to bring that location up to the Curie temperature of the lossy heating particles in that location.

The heaters of this invention are particularly well suited to function as elongate heaters especially cylindrical or tubular-type heaters using the appropriately selected rubber or elastomeric material such as an RTV silicone and an induction coil which is comprised of a flexible wire coil. The heaters of this invention can be made in substantially any desired length, diameter, flexibility and heating characteristics. Such heaters can be adapted for use in heating wells, inside tubes or in other confined spaces in which self-regulating constant temperature heating is desired. The heaters of this invention can provide numerous advantages in such uses and configurations. For example the heaters of this invention can be placed in a tube or heating well and still be easily removed following long periods of use. Since the heaters of this invention will not form corrosion in those circumstances where metallic-type heaters typically corrode or rust are difficult to remove from a heating well or a tube. In addition, heaters according to this invention can be removed from such confined spaces more easily than rigid heaters because the heaters of this invention can be pulled from a heating well or tube whereby the heater of this invention will stretch and elongate, thereby reducing in diameter, to facilitate its removable from such a confined space.

The heaters of this invention can be made in numerous configurations including the flat and block heaters illustrated in FIGS. 1, 2 and 3. In addition, cylindrical or elongate heaters of the type shown in FIG. 5 can be made in a number of configurations as desired to fulfill various heating requirements. For example, an appropriate induction coil may typically be a coil of appropriate gauge wire which may or may not be surface insulated with a polyamide coating or other insulation. The selected induction coil 6 may simply be placed in a mold and the elastomer or rubber body 7 containing lossy heating particles 9 cast and cured around induction coil 6. To form heaters of other configurations the induction coil wire may be wrapped around a core 8, then placed in a mold and the elastomer or rubber body 7 cast and cured around coil 6. Core 8 around which the induction coil is wrapped may be removable or may be permanent. It may be desired to have core 8 removable after body 7 of the heater has cured thus providing a tubular heater with an air-core or hollow core through which materials or articles may be passed for heating in the internal space of the heater. On the other hand, core 8 may be a permanent type core which would provide certain desired properties for the heater. For example, core 8 could be a ferrite material which has high permeability, but is non-lossy, thereby providing magnetic coupling, impedance matching and focusing of the magnetic field for the heater as a whole. Where the core is non-lossy heat will not be produced in the internal part of the heater where it is difficult to utilize but only in the external part of the heater where lossy heating particles 9 are present in the rubber or elastomer body 7 cast around induction coil 6.

In another aspect, the use of a removable core can provide yet another configuration of the heater of this invention as follows. After the elastomer or rubber body 7 has been cast around induction coil 6 and cured and the removable core 8 removed, the cavity in the center of the heater can then be filled with any desired material or a different core inserted in the cavity. For example, it may be desirable to fill the cavity with a different elastomer or rubber containing different magnetic particles and allow the elastomer or rubber to cure in the cavity. This method provides a unitary heater according to this invention having desired overall properties and performance characteristics where part of body 7 has certain properties and core 8 part of the body has other characteristics. Induction coil 6 is connected to an appropriate power supply through connectors 10.

In another aspect, this invention provides certain advantages in that the electrical components such as capacitors which are desired to adjust the overall impedance of the heater, such as impedance matching for particular power supplies, can be molded into the body of the heater along with the induction coil. This advantage again provides a unitary heater which is a single component simply having external connection means for connection with a desired power supply. This provides a self-regulating heater which is simple for the worker to use or install.

In another embodiment, it may be desirable to provide an external layer on the heater containing particles having high permeability but which are non-lossy. Such a layer of highly permeable, non-lossy particles can provide shielding to prevent radio frequency emissions from emanating from the heater. In order to provide the desired shielding, the external layer of non-lossy particles will need to have a Curie temperature greater than the self-regulation temperature of the heater.

As will be apparent to one skilled in the art, numerous modifications and improvements of the heaters of this invention can be adapted and incorporated for particular desired uses of the heater. For example, a mixture of lossy heating particles may be incorporated wherein a portion of the particles produce heat in response to a particular frequency of the alternating magnetic field produced by the induction coil and another portion of the particles respond to a different frequency. In such a configuration the heater can be heated at the first frequency to the Curie temperature of the first particles for the desired period of time, then the frequency shifted to the second frequency to provide heating by the second particles to the Curie temperature of the second particles for the desired period of time. As mentioned above, a combination of lossy heating particles and non-lossy particles can be used in a desired configuration and ratio to focus or intensify the magnetic field produced by the induction coil as desired and/or to maintain the focus of the magnetic field while the lossy heating particles are at their Curie temperature and their magnetic permeability reduced. The particles employed herein can be coated particles. For example ferrite particles coated with a metallic coating can provide certain advantages in the combination of hysteresis and eddy current heating. In addition, it will be apparent that the concentration of particles may be varied across the cross-section or area of the heater. For example, it may be desirable to have a higher concentration of lossy heating particles in the areas where the maximum heat is desired or in the areas where the magnetic field is less intense in order to produce sufficient heat in those areas. Conversly, the concentration of lossy heating particles may be reduced in those areas where maximum heating is not desired or in those areas where the maximum magnetic field exists for the particular induction coil used, thereby providing means for producing uniform maximum watt density across the cross-section or surface area of the heater.

In addition, it may be desirable to incorporate other materials to enhance the thermal conductivity of the heater body. These materials can be metallic, such as copper powder, or non-metallic, such as boron nitride powder or powdered diamond. As will be apparent to one skilled in the art the use of coated particles of metallic particles and the like will necessitate attention to providing appropriate electrical insulation in the body of the heater to prevent the formation of electrically conducting pathways which might produce undesirable results. Other variations and modifications of the heaters of this invention will be apparent to one skilled in the art.

What is claimed is:

1. A self-regulating heater, comprising:

a body comprising electrically non-conductive material; an internal induction coil embedded within the body;

lossy heating particles dispersed within the body, the lossy heating particles producing heat when subjected to an alternating magnetic field produced by the internal induction coil, the lossy heating particles having a Curie transition temperature approximately equal to an auto-regulation temperature at which the body is heated; and connection means for supplying power to the internal induction coil so that the induction coil can produce an alternating magnetic field of sufficient intensity to cause the lossy heating particles to heat the body to the auto-regulation temperature.

2. The heater of claim 1, wherein the lossy heating particles comprise ferrites.

3. The heater of claim 1, wherein the electrically non-conductive material comprises an elastomer, rubber or gel-type material.

4. The heater of claim 1, wherein the lossy heating particles comprise ferrimagnetic particles.

5. The heater of claim 1, wherein the lossy heating particles comprise ferromagnetic particles.

6. The heater of claim 1, wherein the lossy heating particles are dispersed throughout at least a portion of the body.

7. The heater of claim 1, wherein the lossy heating particles are evenly distributed throughout all of the body.

8. The heater of claim 1, wherein the induction coil comprises an elongated member having a cylindrical cross-section and a plurality of coils therein.

9. The heater of claim 1, wherein the induction coil comprises an elongated member having a flat cross-section and a plurality of coils therein.

10. The heater of claim 1, wherein the particles are distributed in the body such that all parts of the body are heated to a substantially uniform temperature equal to the Curie temperature by supplying power to the induction coil.

11. The heater of claim 1, wherein the body of electrically non-conductive material is conformable to an uneven surface.

12. The heater of claim 1, wherein the electrically nonconductive material comprises silicone rubber.

13. The heater of claim 1, wherein the electrically nonconductive material comprises plastic, the lossy heating particles comprise ferrite particles dispersed in the plastic, and the plastic with the lossy heating particles dispersed comprises a molded shape around the induction coil.

14. The heater of claim 1, further comprising power means for supplying a constant current to the connection means, the power supply providing high frequency alternating current to the induction coil at a preselected frequency effective for heating the lossy heating particles.

15. The heater of claim 1, wherein the induction coil is located in the middle of the body and the body is slightly larger than the induction coil.

16. The heater of claim 1, wherein the induction coil is located in only one-half of the body at one end of the body.

17. The heater of claim 1, wherein a magnetic field generated by the induction coil initially causes lossy heating particles located closest to the induction coil to reach their Curie point after which lossy heating particles located further from the induction coil are heated by the magnetic field, whereby magnetic flux is concentrated close to the induction coil when the body is cold and as portions of the body closest to the induction coil reach the Curie temperature, permeability drops and the magnetic flux expands outward so as to prevent overheating of a central core part of the body.

18. The heater of claim 1, wherein the body includes two opposed surfaces, the induction coil is a coplanar coil formed of flat ribbon conductor located between the opposed surfaces.

19. The heater of claim 1, wherein the body includes two opposed surfaces, the induction coil including a plurality of coils extending in a helical pattern about a central axis, the coils being located inwardly of the opposed surfaces.

20. A heater of claim 1 wherein the lossy heating particles are present in higher concentration in an area within the body for increased heating in said area.

21. A heater of claim 1 further comprising power means for supplying current to the connection means, the power supply providing high frequency alternating current to the induction coil at a preselected frequency effective for heating the lossy heating particles.

22. A method of manufacturing a self-regulating heater, comprising:

providing a body comprising electrically non-conductive material;

providing an internal induction coil embedded within the body;

providing lossy heating particles dispersed within the body, the lossy heating particles producing heat when subjected to an alternating magnetic field produced by the internal induction coil, the lossy heating particles having a Curie transition temperature approximately equal to an auto-regulation temperature at which the body is heated; and providing connection means for supplying power to the internal induction coil so that the induction coil can produce an alternating magnetic field of sufficient intensity to cause the lossy heating particles to heat the body to the auto-regulated temperature.

23. The method of claim 22, wherein the lossy heating particles comprise ferrites.

24. The heater of claim 22, wherein the induction coil is embedded within the body by molding the electrically nonconductive material around the induction coil.

25. The heater of claim 22, wherein the lossy heating particles comprise ferromagnetic particles or ferrimagnetic particles.

26. The heater of claim 22, wherein the body includes a cavity therein and the induction coil is inserted in the cavity.

27. The heater of claim 22, wherein the lossy heating particles are evenly distributed throughout all of the body.

28. The heater of claim 22, wherein the induction coil is formed of a flat elongated member to provide a coplanar coil.

29. The heater of claim 22, wherein the electrically non-conductive material comprises silicone rubber.

30. The heater of claim 22, wherein the electrically non-conductive material comprises plastic, the lossy heating particles comprise ferrite particles dispersed in the plastic, and the plastic with the lossy heating particles dispersed therein is molded around the induction coil.

31. The heater of claim 22, wherein the induction coil is provided in the middle of the body and the body is slightly larger than the induction coil.

32. The method of claim 22, further comprising providing power means for supplying current to the connection means, the power supply providing high frequency alternating current to the induction coil at a preselected frequency effective for heating the lossy heating particles.

33. The method of claim 22, further comprising providing power means for supplying a constant current to the connection means, the power supply providing high frequency alternating current to the induction coil at a preselected frequency effective for heating the lossy heating particles.

34. A method of claim 22 comprising providing lossy heating particles in higher concentration in an area within the body for increased heating in said area.

* * * * *

UNITED STATES PATENT AND TRADEMARK OFFICE

CERTIFICATE OF CORRECTION

PATENT NO. : 5,087,804

DATED : February 11, 1992

INVENTOR(S) : Thomas H. McGaffigan

It is certified that error appears in the above-identified patent and that said Letters Patent is hereby corrected as shown below:

Column 9, line 29, delete "polyamide" and insert --polyimide-- therefor.

Column 12, line 52, line 55, line 58, line 61, line 64, line 67, delete "heater" and insert --method-- therefor.

Column 13, line 1, line 7, delete "heater" and insert --method-- therefor.

Column 13, line 10, following "comprising" insert --the step of--.

Column 14, line 3, line 10, following "comprising" insert --the step of--.

Column 14, line 4, delete "a constant".

Signed and Sealed this

Seventh Day of September, 1993

Bruce Lehman

*Attest:*

BRUCE LEHMAN

*Attesting Officer*

*Commissioner of Patents and Trademarks*